US007057138B2

(12) United States Patent
Lopez et al.

(10) Patent No.: US 7,057,138 B2
(45) Date of Patent: Jun. 6, 2006

(54) APPARATUS FOR CONTROLLING TEMPERATURE PROFILES IN LIQUID DROPLET EJECTORS

(75) Inventors: Ali Lopez, Pittsford, NY (US); Christopher N. Delametter, Rochester, NY (US); Thomas M. Stephany, Churchville, NY (US); Gilbert A. Hawkins, Mendon, NY (US)

(73) Assignee: Eastman Kodak Company, Rochester, NY (US)

( * ) Notice: Subject to any disclaimer, the term of this patent is extended or adjusted under 35 U.S.C. 154(b) by 75 days.

(21) Appl. No.: 10/830,688

(22) Filed: Apr. 23, 2004

(65) Prior Publication Data

US 2005/0247689 A1 Nov. 10, 2005

(51) Int. Cl.
*H05B 1/00* (2006.01)

(52) U.S. Cl. ..... 219/216; 347/15; 347/18; 347/19

(58) Field of Classification Search ..... 219/216, 219/534, 535, 543, 544; 392/472, 481, 488; 347/15, 18, 19, 48, 61, 62
See application file for complete search history.

(56) References Cited

U.S. PATENT DOCUMENTS

| | | | | |
|---|---|---|---|---|
| 6,089,692 | A | 7/2000 | Anagnostopoulos et al. | |
| 6,146,914 | A * | 11/2000 | Burke et al. | 438/21 |
| 6,367,147 | B1 | 4/2002 | Giere et al. | |
| 6,460,961 | B1 * | 10/2002 | Lee et al. | 347/15 |
| 6,588,888 | B1 | 7/2003 | Jeanmaire et al. | |
| 6,739,519 | B1 * | 5/2004 | Stout et al. | 239/102.2 |
| 6,824,252 | B1 * | 11/2004 | Silverbrook | 347/54 |
| 6,830,320 | B1 * | 12/2004 | Hawkins et al. | 347/77 |
| 2003/0197761 | A1 | 10/2003 | Sugoika | |
| 2004/0179716 | A1 * | 9/2004 | Tafuku et al. | 382/103 |
| 2004/0263578 | A1 * | 12/2004 | Lee et al. | 347/65 |

FOREIGN PATENT DOCUMENTS

| | | |
|---|---|---|
| EP | 0 911 166 | 4/1999 |
| EP | 0 911 168 | 4/1999 |
| EP | 1 160 085 | 12/2001 |
| EP | 1 219 426 | 7/2002 |

* cited by examiner

*Primary Examiner*—Robin Evans
*Assistant Examiner*—Vinod Patel
(74) *Attorney, Agent, or Firm*—William R. Zimmerli

(57) ABSTRACT

A heater is provided. The heater includes a first material having a circular form and a first sheet resistively. The first material has a first radius of curvature. The heater also includes a second material having a circular form and a second sheet resistively. The second material is positioned adjacent to the first material and has a second radius of curvature. The first radius of curvature is greater than the second radius of curvature and the first sheet resistively is less than the second sheet resistively.

20 Claims, 8 Drawing Sheets

APPARATUS FOR CONTROLLING TEMPERATURE PROFILES IN LIQUID DROPLET EJECTORS

FIELD OF THE INVENTION

The invention relates generally to the field of liquid droplet ejection, for example, inkjet printing, and more specifically to an apparatus for controlling temperature profiles in liquid droplet ejection mechanisms.

BACKGROUND OF THE INVENTION

The state of the art of inkjet printing, as one type of liquid droplet ejection, is relatively well developed. A wide variety of inkjet printing apparatus are available for commercial purchase from consumer desktop printers that produce general documents to commercial wide format printers that produce huge photographic quality posters.

A thermal inkjet printer typically comprises a transitionally reciprocating printhead that is fed by a source of ink to produce an image-wise pattern upon some type of receiver. Such printheads are comprised of an array of nozzles through which droplets of ink are ejected by the rapid heating of a volume of ink that resides in a chamber behind a given nozzle. This heating is accomplished through the use of a heater resistor that is positioned within the print head in the vicinity of the nozzle. The heater resistor driven by an electrical pulse that creates a precise vapor bubble that expands with time to eject a droplet of ink from the nozzle. Upon the drop being ejected and the electrical pulse terminated, the ink chamber refills and is ready to further eject additional droplets when the heater resistor is again energized.

The quality of an ejected droplet from a thermal inkjet printer is dependent upon the precision of the vapor bubble that is produced by the heater resistor, and is therefore dependent upon how uniformly the heater resistor produces heat. Since it is desirable to shape heater resistors to better control the quality and trajectory of the ejected droplet, these shapes can also create design issues of their own. Heater resistors of various shapes are known. More specifically, heaters in the form of rings are known. U.S. Pat. No. 6,588,888 by Jeanmaire et al. teaches that heaters that are disposed within droplet forming mechanisms can be formed in a ring shape or a partial ring shape.

Inkjet heater resistors by their nature must reside in compact areas, such as within a small printhead. When these resistors are placed within miniature enclosures and are constructed of various curved shapes, current flows through the shortest path that is available. That is to say that if there is a source of current that flows through a conductor, and that conductor provides both a short and a long path to the flow of current, the current will bias itself to take the shorter path. This is defined as current crowding, since more current will flow within the shorter portion of the conductor than the longer portion of the conductor. This being understood, the two paths of current within a conductor will also produce a non-uniform heating profile due to the non-uniform current flow. This is known and addressed in U.S. Pat. No. 6,367,147 by Giere et al., wherein the inventors use current balancing resistors to minimize such effects.

The ability of a material to resist the flow of electricity is a property called resistively. Resistively is a function of the material used to make a resistor and does not depend on the geometry of the resistor. Resistively is related to resistance by:

$$R=pL/A$$

Where R is the resistance (Ohms); p is the resistively in (Ohms-cm); L is the length of the resistor; and A is the cross sectional area of the resistor. In thin film applications, a property known as sheet resistance (Rsheet) is commonly used in the analysis and design of heater resistors. Sheet resistance is the resistively of a material divided by the thickness of the heater resistor constructed from that material, the resistance of the heater resistor determined by the equation:

$$R=R\text{sheet}(L/W)$$

where L is the length of the heater resistor and W is the width of the heater resistor.

The construction of heater resistors using the CMOS process is desirable and lends particular efficiencies to ink jet printer manufacturing. Moreover, the selective doping of the base polysilicon with elements such as Arsenic, Boron and Phosphorus produce variable sheet resistivities. These resistivities can vary from a minimum of 1 milliohm-cm to 100 ohm-cm. This ability to selectively dope the base sheet resistances allows the construction of heater resistors in the same polysilicon as other necessary structures. Additionally, by adding electronic drivers and the like to the base structure reduces costs and improves process efficiencies by a reducing production steps and the eliminating the need for other materials.

Inkjet heater resistors constructed of a circular shape are subject to the current crowding effect. Additionally, the doping of polysilicon to create heater resistors is both cost-effective and desirable in the full utilization of the CMOS process to produce inkjet printheads. The present invention is directed towards overcoming one or more of the problems set forth above.

SUMMARY OF THE INVENTION

According to one feature of the present invention, a heater includes a first material having a circular form and a first sheet resistively. The first material has a first radius of curvature. The heater has a second material having a circular form and a second sheet resistively. The second material is positioned adjacent to the first material and has a second radius of curvature. The first radius of curvature is greater than the second radius of curvature and the first sheet resistively is less than the second sheet resistively.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 1:
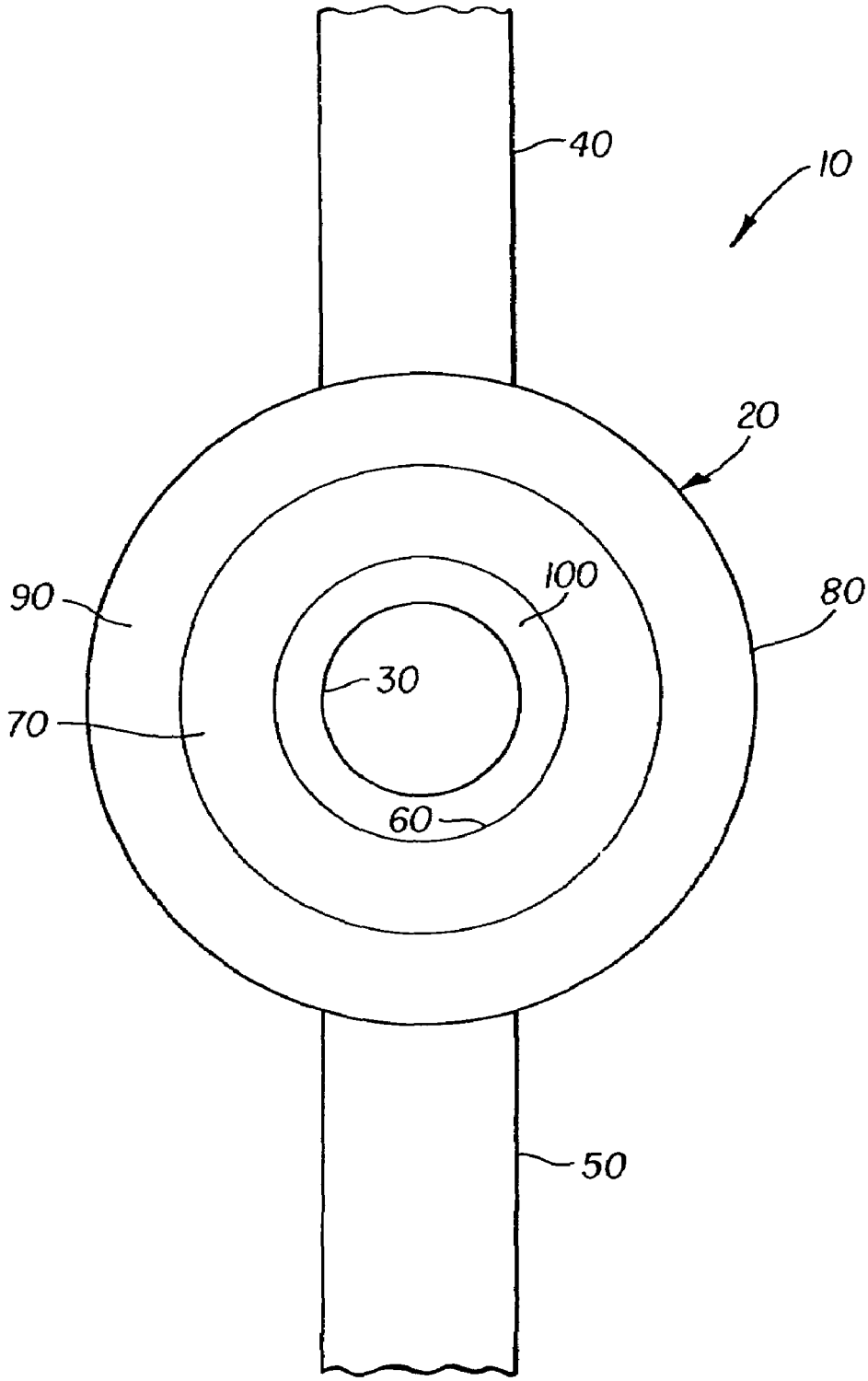
FIG. 1 is a two dimensional view of an inkjet orifice surrounded by a ring heater.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate elements common to the figures.

Referring to FIG. 1, drawn is a two dimensional view of the substrate of an orifice plate 10 upon which is disposed an inkjet heater 20 which is arranged about an ejection nozzle 30. An electrical input conductor 40 and an electrical output conductor 50 supply electrical current to the inkjet heater 20. The circular or ring-like construction of the inkjet heater 20 by its physical nature allows a shorter current path around the inside path 60 versus the outside path 80 of the inkjet heater 20. Also shown for means of clarification are an inside portion 70 of the inkjet heater 20 and an outside portion 90 of the inkjet heater 20. Disposed between the outside portion 90 of the inkjet heater 20 and the ejection nozzle 30 is an unused portion of the base substrate 100 from which the orifice plate 10 is constructed.

Figure 2:
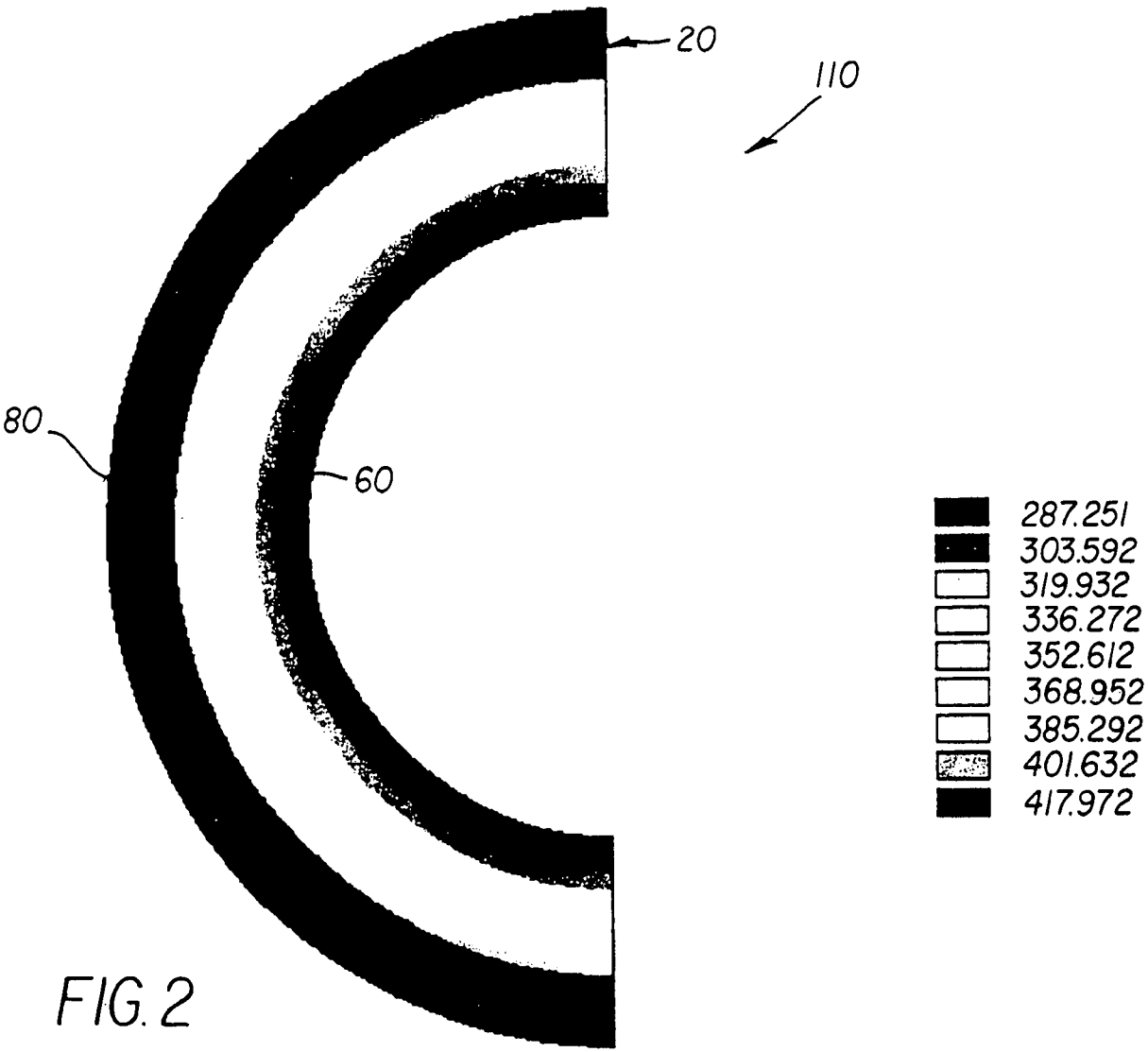
FIG. 2 is a detail of a non-uniform temperature profile produced by an uncorrected ring heater.

Referring now to FIG. 2, shown is the detail of a non-uniform temperature profile 110 that will occur in an uncorrected inkjet heater 20. The application of a specific electrical current across the electrical input conductor 40 and the electrical output conductor 50 (from FIG. 1) results in non-uniform heating of the inkjet heater 20. It should be noted that only ½ of the inkjet heater 20 is detailed for purposes of clarity. It is apparent that, for a given voltage drop, the thermal gradient induced into an uncorrected inkjet heater 20 ranges from 287 degrees Centigrade in the outside path 80 of the inkjet heater 20 to 418 degrees Centigrade in the inside path 60 of the inkjet heater 20. Thusly, the variation in temperature across the inkjet heater 20 totals 131 degrees Centigrade and cause problems in thermal bubble formation.

Figure 3:
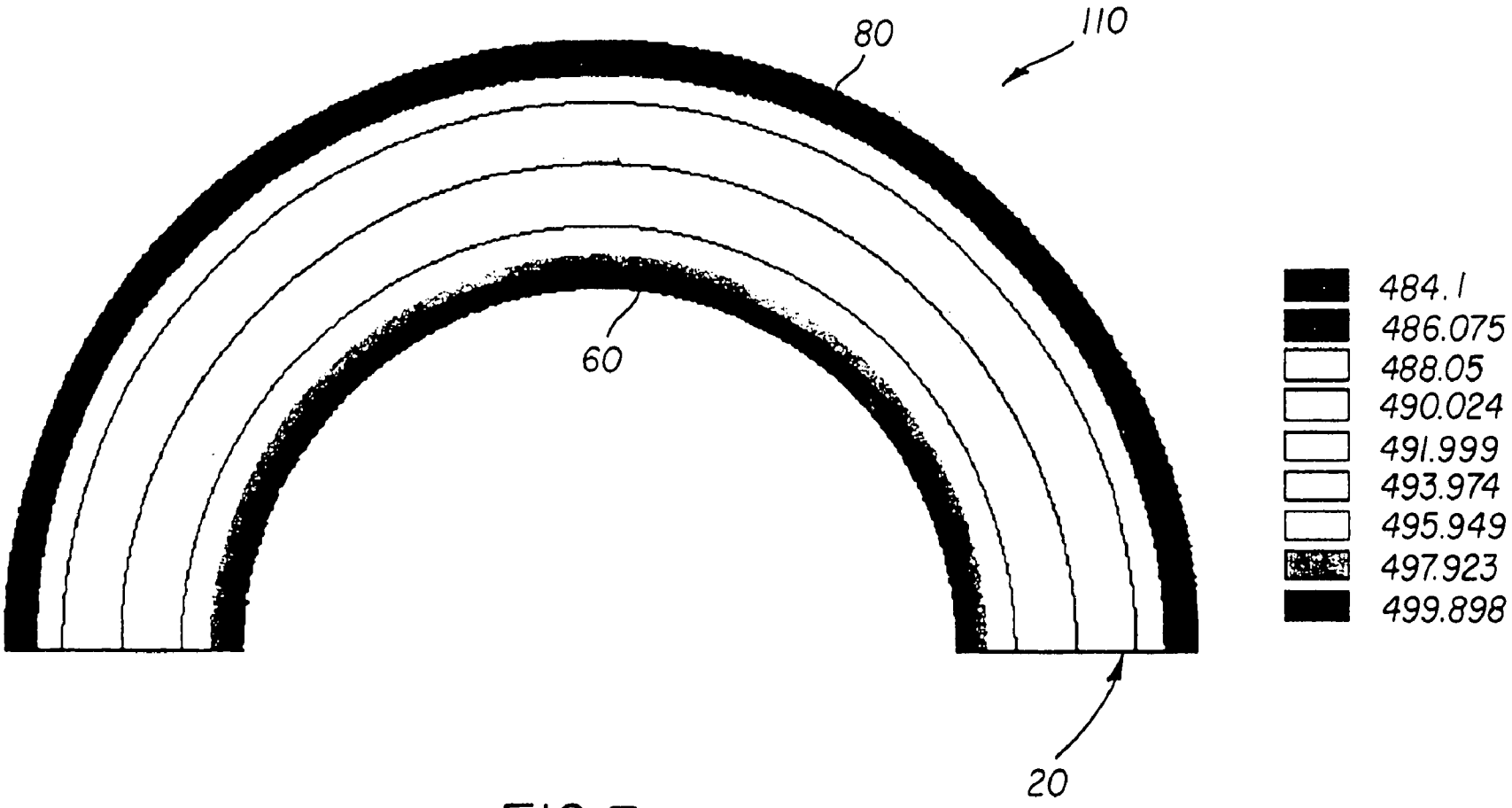
FIG. 3 is a detail of a corrected temperature profile produced by a corrected ring heater.

Referring now to FIG. 3, shown is the detail of a uniform temperature profile 120 that will occur in a corrected inkjet heater 20 when applying one of a variety of possible correction methods of the present invention. Again it should be noted that only ½ of the inkjet heater 20 is detailed for purposes of clarity. It is apparent from the uniform temperature profile 120 that the temperature gradient in a corrected inkjet heater 20 ranges from 484 degrees Centigrade in the outside path 80 of the inkjet heater 20 to 500 degrees Centigrade in the inside path 60 of the inkjet heater 20. It should also be noted that the same specific voltage drop is applied as in the prior example. Thus the variation in temperature across the inkjet heater 20 is reduced to total only 16 degrees Centigrade and will substantially eliminate undesired effects in thermal bubble formation.

Figure 4:
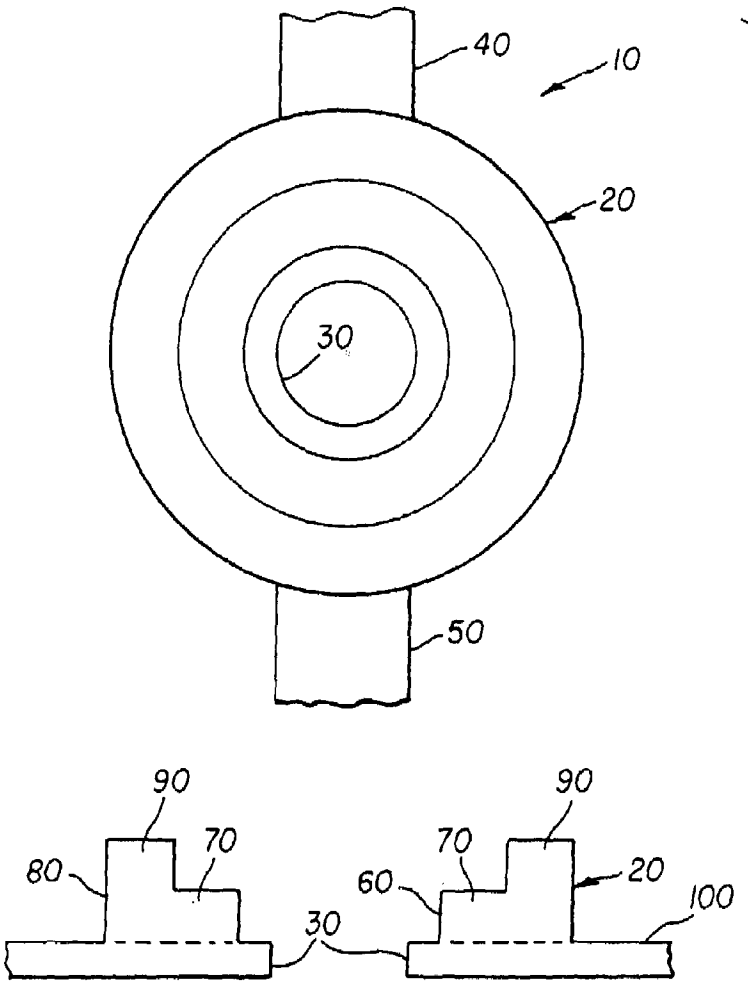
FIG. 4 is a detail of a two dimensional view of an inkjet orifice surrounded by a ring heater and accompanied by its cross-sectional view of it's construction.

Referring now to FIG. 4, a drawing is shown that details a two dimensional view of a orifice plate 10 that comprises an inkjet heater 20 that is arranged about an ejection nozzle 30. An electrical input conductor 40 and an electrical output conductor 50 supply electrical current to the inkjet heater 20. The ringed construction of the inkjet heater 20 by nature of physics allows a shorter current path around the inside path 60 versus the outside path 80 of a current flowing through inkjet heater 20. Additionally FIG. 4 details the construction of the orifice plate 10 in cross-sectional view built upon a base substrate 100. Establishing a flow of current through input conductor 40 and output conductor 50 that flows through the inkjet heater 20 creates the non-uniform heating profile previously discussed in FIG. 2. This non-uniform heating is corrected by using a method as shown in the profile drawing of FIG. 4. In this implementation, the outside portion 90 of the inkjet heater 20 is thicker than the inside portion 70 of the inkjet heater 20, and their relative widths are equal. This situation establishes a condition wherein the outside portion 90 of the inkjet heater 20 has a larger cross-sectional area than the inside portion 70 of the inkjet heater 20. A larger cross-sectional area exhibits lower resistance to current flow than a smaller cross sectional area. Thus, the resistance change brought about by a corresponding change in cross-sectional area will normalize the current flow to be uniformly distributed through the inkjet heater 20. Current that flows by virtue of current crowding through the path of lowest resistance will be denied that ability by making all the current paths through the heater resistor 20 equal to each other. This fact enables an equal flow of current through the heater resistor 20, and whose temperature profile embodies the uniform temperature profile 120 discussed in FIG. 3.

Figure 5:
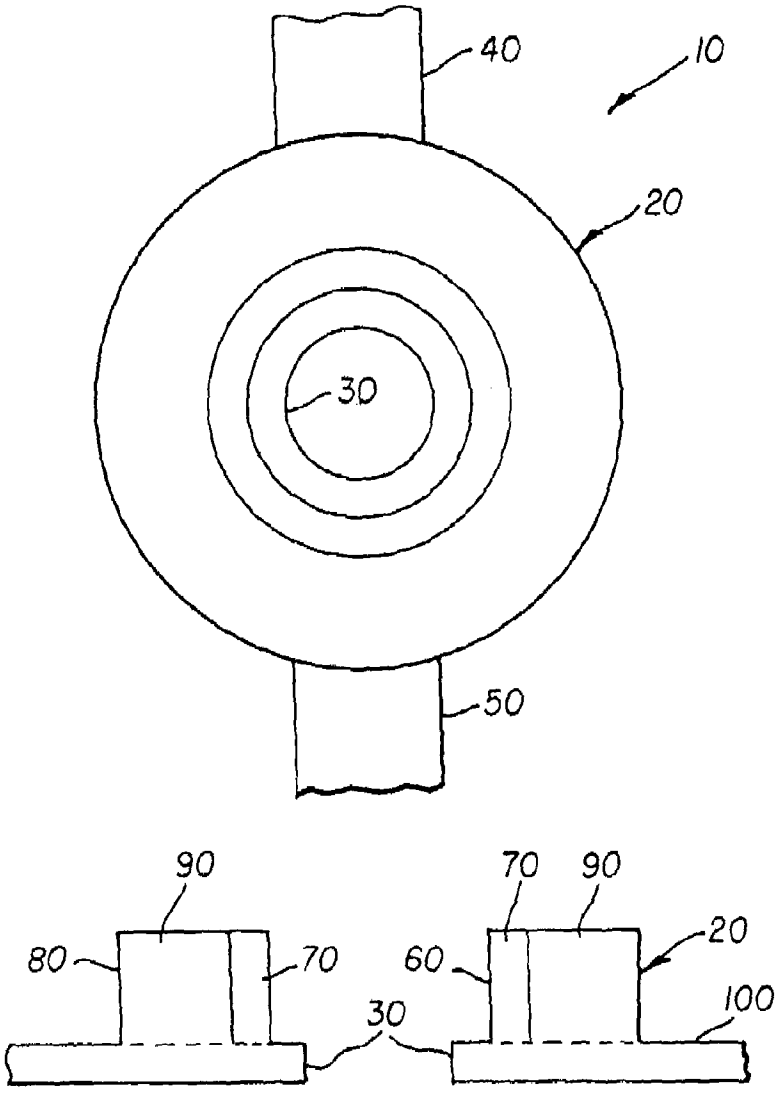
FIG. 5 is a detail of a two dimensional view of an inkjet orifice surrounded by a ring heater and accompanied by its cross-sectional view of it's construction.

Referring now to FIG. 5, an additional drawing is shown that details a two dimensional view of a orifice plate 10 that comprises an inkjet heater 20 that is arranged about an ejection nozzle 30. An electrical input conductor 40 and an electrical output conductor 50 supply electrical current to the inkjet heater 20. The ringed construction of the inkjet heater 20 by nature of physics allows a shorter current path around the inside path 60 versus the outside path 80 of a current flowing through inkjet heater 20. Additionally FIG. 5 details the construction of the orifice plate 10 in cross-sectional view built upon a base substrate 100. Establishing a flow of current through input conductor 40 and output conductor 50 that flows through the inkjet heater 20 creates the non-uniform heating profile previously discussed in FIG. 2. This non-uniform heating is corrected by using a method as shown in the profile drawing of FIG. 5. In this implementation, the outside portion 90 of the inkjet heater 20 is wider and has a higher doping than the inside portion 70. The outside portion 90 of the inkjet heater 20 has a larger cross-sectional area than the inside portion 70 of the inkjet heater 20. This condition creates a proper normalization. Current that wants to flow by virtue of current crowding through the path of lowest resistance will be denied that ability by making all the current paths through the heater resistor 20 equal to each other. This fact enables an equal flow of current through the heater resistor 20, and whose temperature profile embodies the uniform temperature profile 120 discussed in FIG. 3.

Figure 6:
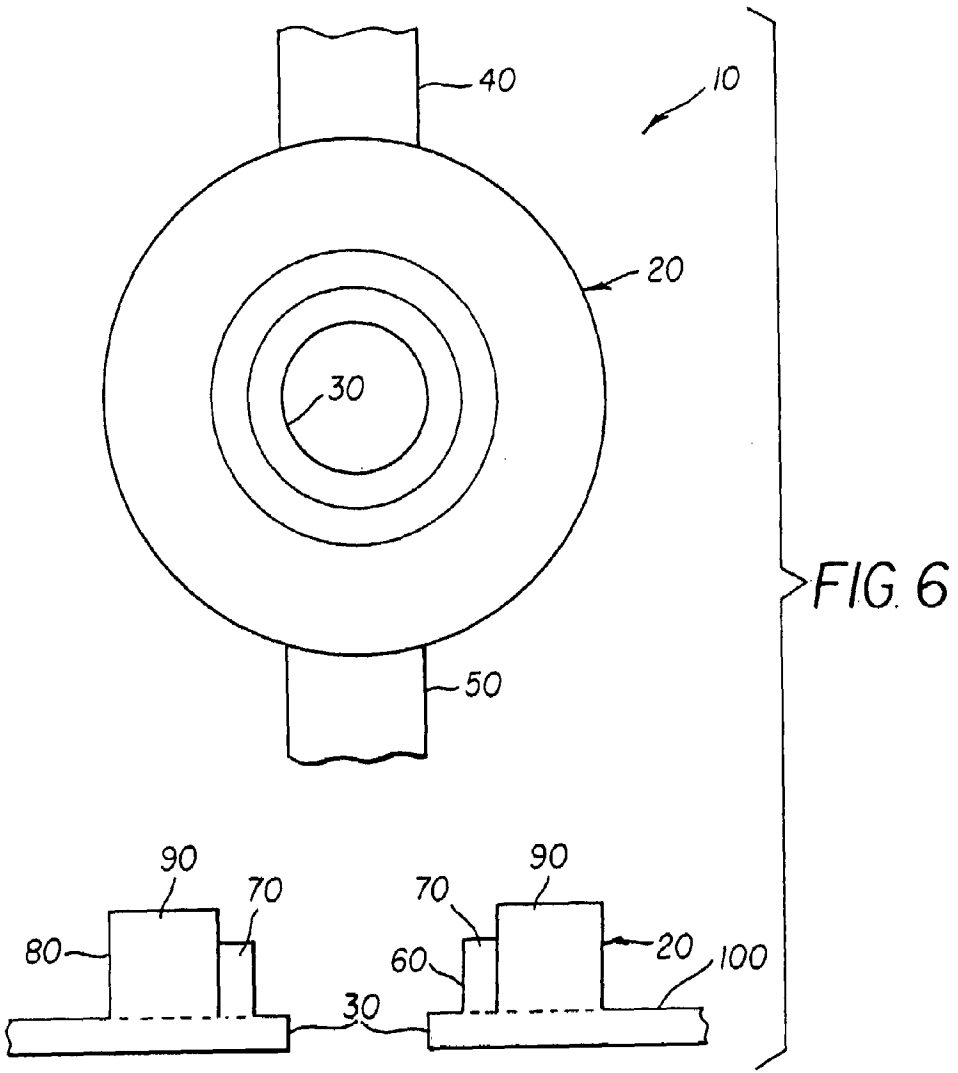
FIG. 6 is a detail of a two dimensional view of an inkjet orifice surrounded by a ring heater and accompanied by its cross-sectional view of it's construction.

Referring now to FIG. 6, a drawing is shown that details a two dimensional view of a orifice plate 10 that comprises an inkjet heater 20 that is arranged about an ejection nozzle 30. An electrical input conductor 40 and an electrical output conductor 50 supply electrical current to the inkjet heater 20. The ringed construction of the inkjet heater 20 by nature of physics allows a shorter current path around the inside path 60 versus the outside path 80 of a current flowing through inkjet heater 20. Additionally FIG. 6 details the construction of the orifice plate 10 in cross-sectional view built upon a base substrate 100. Establishing a flow of current through input conductor 40 and output conductor 50 that flows through the inkjet heater 20 creates the non-uniform heating profile previously discussed in FIG. 2. This non-uniform heating is corrected by using a method as shown in the profile drawing of FIG. 6. In this implementation, the outside portion 90 of the inkjet heater 20 is thicker than the inside portion 70 of the inkjet heater 20, and their relative widths are unequal, inside portion 70 being thinner than outside portion 90. This situation establishes a condition wherein the outside portion 90 of the inkjet heater 20 has a larger cross-sectional area than the inside portion 70 of the inkjet heater 20. This condition over-compensates the equalization of the resistance of inkjet heater 20, and causes excessive current to flow in the outside portion 90. Selectively doping the inside portion 70 slightly heavier than outside portion 90 will cause a change in the sheet resistively, making the inside portion 70 more conductive than the outside portion 90 and will normalize the current flow to be uniformly distributed through the inkjet heater 20. Current that wants to flow by virtue of current crowding through the path of lowest resistance will be denied that ability by making all the current paths through the heater resistor 20 equal to each other. This fact enables an equal flow of current through the heater resistor 20, and whose temperature profile embodies the uniform temperature profile 120 discussed in FIG. 3.

Figure 7:
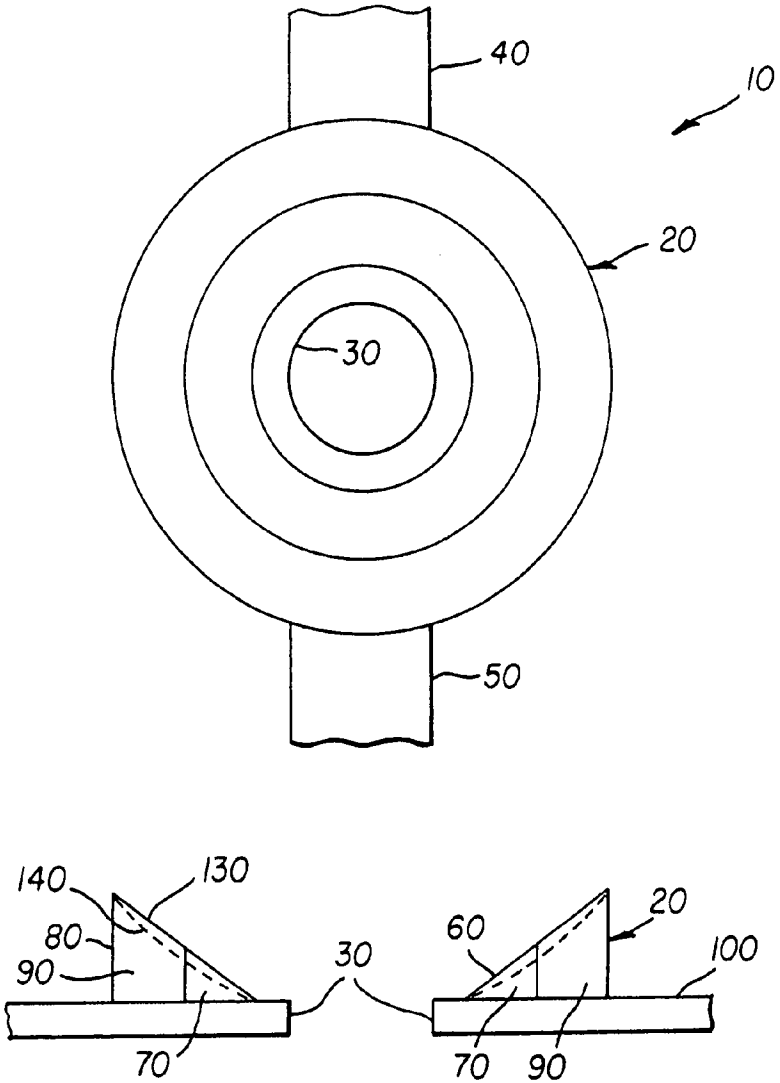
FIG. 7 is a detail of a two dimensional view of an inkjet orifice surrounded by a ring heater and accompanied by its cross-sectional view of it's construction.

Referring now to FIG. 7, a drawing is shown that details a two dimensional view of a orifice plate 10 that comprises an inkjet heater 20 that is arranged about an ejection nozzle 30. An electrical input conductor 40 and an electrical output conductor 50 supply electrical current to the inkjet heater 20. The ringed construction of the inkjet heater 20 by nature of physics allows a shorter current path around the inside path 60 versus the outside path 80 of a current flowing through inkjet heater 20. Additionally FIG. 7 details the construction of the orifice plate 10 in cross-sectional view built upon a base substrate 100. Establishing a flow of current through input conductor 40 and output conductor 50 that flows through the inkjet heater 20 creates the non-uniform heating profile previously discussed in FIG. 2. This non-uniform heating is corrected by using a method as shown in the profile drawing of FIG. 7. In this implementation, the outside portion 90 of the inkjet heater 20 is sloped 130 in relation to the inside portion 70 of the inkjet heater 20, and their relative widths in relation to one another are equal. It should be understood that in keeping with the prior descriptions they can also be unequal, and that the sloped 130 condition can also be an actuate 140 condition or exhibit some uniform or non-uniform radius of curvature. This configuration establishes a situation wherein the outside portion 90 of the inkjet heater 20 has a larger cross-sectional area than the inside portion 70 of the inkjet heater 20. A larger cross-sectional area exhibits lower resistance to current flow than a smaller cross sectional area. Thus, the resistance change brought about by a corresponding change in cross-sectional area will normalize the current flow to be uniformly distributed through the inkjet heater 20. Current that wants to flow by virtue of current crowding through the path of lowest resistance will be denied that ability by making all the current paths through the heater resistor 20 equal to each other. This fact enables an equal flow of current through the heater resistor 20, and whose temperature profile embodies the uniform temperature profile 120 discussed in FIG. 3.

Figure 8:
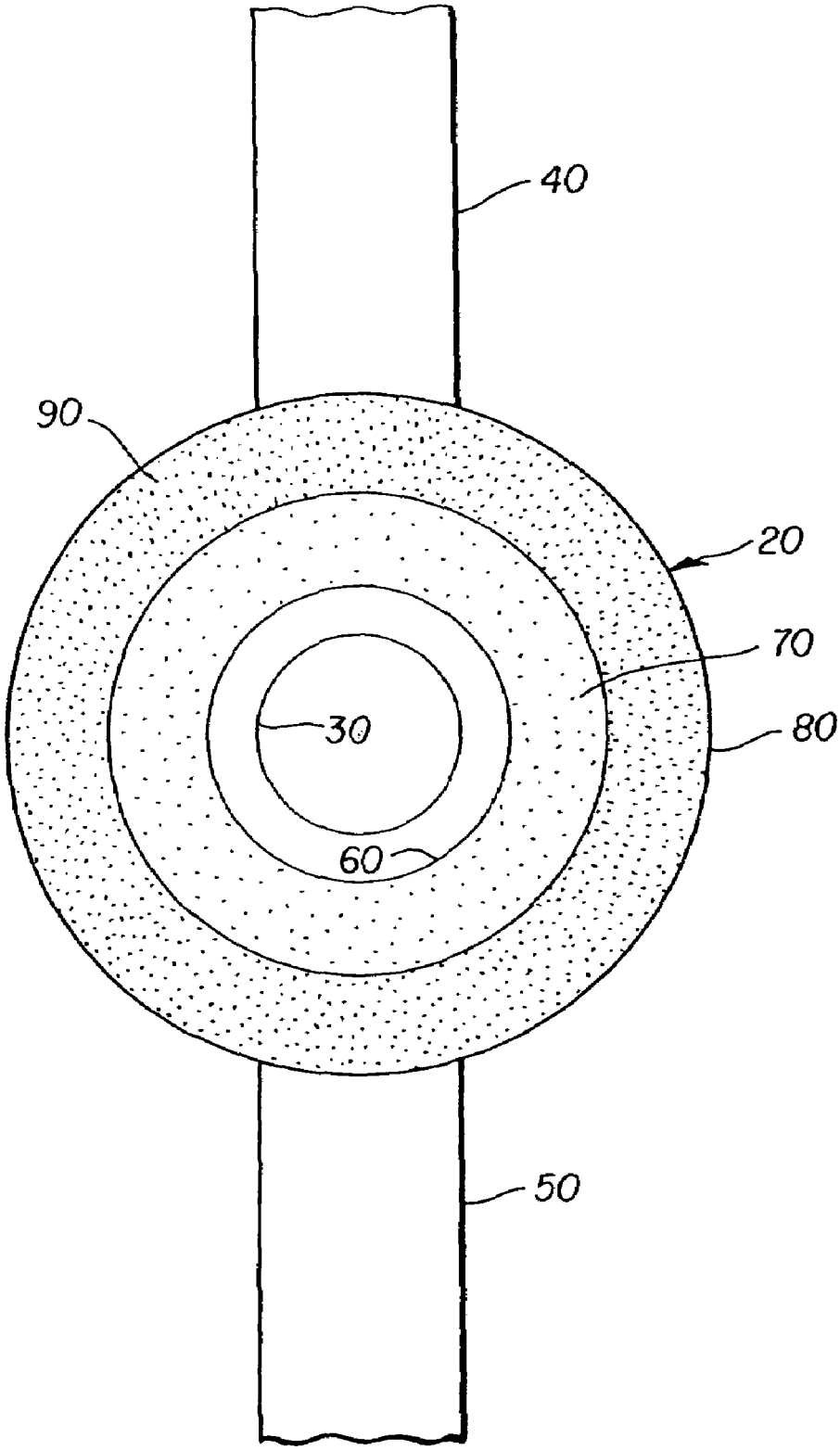
FIG. 8 is a detail of a corrected temperature profile produced by a corrected ring heater using selective doping.

Referring now to FIG. 8, a drawing is shown that details a two dimensional view of a orifice plate 10 that comprises an inkjet heater 20 that is arranged about an ejection nozzle 30. An electrical input conductor 40 and an electrical output conductor 50 supply electrical current to the inkjet heater 20. The ringed construction of the inkjet heater 20 by nature of physics allows a shorter current path around the inside path 60 versus the outside path 80 of a current flowing through inkjet heater 20. Establishing a flow of current through input conductor 40 and output conductor 50 that flows through the inkjet heater 20 creates the non-uniform heating profile previously discussed in FIG. 2. This non-uniform heating is corrected by using a method as shown in FIG. 8. By more heavily doping the outside portion 90 of the inkjet heater 20 than the inside portion 70 of the inkjet heater 20, a normalization of sheet resistance can also be accomplished. It should be noted that this is detailed in FIG. 8, by showing a greater density of dots (doping) within outside portion 90 than the density of dots (doping) within inside portion 70 of inkjet heater 20. This situation establishes a condition wherein the outside portion 90 of the inkjet heater 20 has a lower resistance than the inside portion 70 of the inkjet heater 20. Thus, the resistance change brought about by a corresponding change in area doping will normalize the current flow to be uniformly distributed through the inkjet heater 20. Current that wants to flow by virtue of current crowding through the path of lowest resistance will be denied that ability by making all the current paths through the heater resistor 20 equal to each other. This fact enables an equal flow of current through the heater resistor 20, and whose temperature profile embodies the uniform temperature profile 120 discussed in FIG. 3. It should be noted here that people skilled in the art will realize that an inkjet heater 20 can be divided into a plurality of correction regions and, for purposes of clarity, the previous discussions have been limited to two regions. Doping of the heater can be varied across an inkjet heater 20 in a multiplicity of rings that can vary in thickness and in width due to individual engineering needs. Additionally, for the corrected results shown in FIG. 3, the resistively across the inkjet heater 20 was varied as the square of its radius, when using silicon as a base material. It should be understood by those skilled in the art that the optimum resistively variation across the inkjet heater 20 will vary as the base material varies, (for example silicon vs. glass) based upon the thermal environment.

Although the present invention has been described with reference to inkjet printheads, it is recognized that printheads of this type are being used to eject liquids other than inkjet inks. As such, the present invention finds application as a liquid droplet ejector for use in areas other than and/or in addition to its inkjet printhead application.

The invention has been described in detail with particular reference to certain preferred embodiments thereof, but it will be understood that variations and modifications can be effected within the scope of the invention.

PARTS LIST

10 orifice plate
20 inkjet heater
30 ejection nozzle
40 electrical input conductor
50 electrical output conductor
60 inside path
70 inside portion
80 outside path
90 outside path

100 base substrate
110 non-uniform temperature profile
120 uniform temperature profile
130 sloped
140 actuate

What is claimed is:

1. A heater comprising:

a first material having a circular form and having a first sheet resistively, the first material having a first radius of curvature; and a second material having a circular form and having a second sheet resistively, the second material positioned adjacent to the first material, the second material having a second radius of curvature, wherein the first radius of curvature is greater than the second radius of curvature, and the first sheet resistively is less than the second sheet resistively so that the first material exhibits less resistance than the second material to make the first material to be more conductive than the second material and normalize current flow through the heater.

2. The heater according to claim 1, wherein the first material and the second material are of the same material, the first material having a first doping, the second material having a second doping that is a different doping than the first doping to make the first sheet resistively be less than the second sheet resistively.

3. The heater according to claim 2, wherein the first doping and the second doping are of the same material and of different concentrations.

4. The heater according to claim 1, wherein the first material and the second material are of the same material, the first material having a first thickness, the second material having a second thickness, wherein the first thickness is not equal to the second thickness to make a cross-sectional area of the first material greater than a cross-sectional area of the second material so that the first material exhibits a lower resistance to a current flow through the heater than the second material.

5. The heater according to claim 4, wherein the first thickness and the second thickness are defined in terms of a material width, the first thickness being greater than the second thickness.

6. The heater according to claim 4, wherein the first thickness and the second thickness are defined in terms of a material height, the first thickness being greater than the second thickness.

7. The heater according to claim 4, the heater having a cross sectional profile as viewed in a plane perpendicular to the first radius of curvature, wherein the cross sectional profile is of a stepped profile.

8. The heater according to claim 7, the stepped profile having a height associated with the first material and the second material, the height of the first material being greater than the height of the second material.

9. The heater according to claim 4, the heater having a cross sectional profile as viewed in a plane perpendicular to the first radius of curvature, wherein the cross sectional profile is of a sloped profile.

10. The heater according to claim 1, wherein the first material and the second material are of different materials to make the first sheet resistively less than the second sheet resistively.

11. The heater according to claim 10, the heater having a cross sectional profile as viewed in a plane perpendicular to the first radius of curvature, wherein the cross sectional profile is of a stepped profile to make a cross-sectional area of the first material greater than a cross-sectional area of the second material so that the first material exhibits a lower resistance to a current flow through the heater than the second material.

12. The heater according to claim 10, the heater having a cross sectional profile as viewed in a plane perpendicular to the first radius of curvature, wherein the cross sectional profile is of a sloped profile to make a cross-sectional area of the first material greater than a cross-sectional area of the second material so that the first material exhibits a lower resistance to a current flow through the heater than the second material.

13. The heater according to claim 10, the heater having a cross sectional profile as viewed in a plane perpendicular to the first radius of curvature, wherein the cross sectional profile is of a flat profile.

14. The heater according to claim 10, the heater having a cross sectional profile as viewed in a plane perpendicular to the first radius of curvature, wherein the cross sectional profile is other than a flat profile to make a cross-sectional area of the first material greater than a cross-sectional area of the second material so that the first material exhibits a lower resistance to a current flow through the heater than the second material.

15. The heater according to claim 4, the heater having a cross sectional profile as viewed in a plane perpendicular to the first radius of curvature, wherein the cross sectional profile is other than a flat profile to make a cross-sectional area of the first material greater than a cross-sectional area of the second material so that the first material exhibits a lower resistance to a current flow through the heater than the second material.

16. The heater according to claim 1, wherein the second material is positioned to contact the first material.

17. The heater according to claim 1, wherein the first material has a first doping and the second material has a second doping, the second doping being heavier than the first doping so that the first material exhibits a lower resistance to a current flow through the heater than the first material.

18. A method of controlling temperature profiles in liquid droplets in an inkjet heater that includes (1) a first material having a circular form, a first sheet resistively and a first radius of curvature, and (2) a second material positioned adjacent to the first material and having a circular form, a second sheet resistively and a second radius of curvature, wherein the first radius of curvature is greater than the second radius of curvature, said method comprising:

making the first sheet resistively less than the second sheet resistively so that the first material exhibits less resistance than the second material, to make the first material more conductive than the first material and thereby normalize current flow through the heater.

19. The method according to claim 18, wherein the first sheet resistively is made less than the second sheet resistively by doping the first material heavier than the second material so that the first material exhibits a lower resistance to a current flow through the heater than the first material.

20. The method according to claim 18, wherein a cross-sectional area of the first material is made greater than a cross-sectional area of the second material so that the first material exhibits a lower resistance to a current flow through the heater than the second material.

* * * * *